US010423089B2

(12) United States Patent
Okita

(10) Patent No.: US 10,423,089 B2
(45) **Date of Patent: *Sep. 24, 2019**

(54) POSITIVELY CHARGEABLE TONER

(71) Applicant: KYOCERA Document Solutions Inc., Osaka (JP)

(72) Inventor: Masaki Okita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/163,156

(22) Filed: Oct. 17, 2018

(65) Prior Publication Data

US 2019/0146365 A1 May 16, 2019

(30) Foreign Application Priority Data

Nov. 14, 2017 (JP) ..... 2017-218729

(51) Int. Cl.
*G03G 9/08* (2006.01)
*G03G 9/087* (2006.01)

(52) U.S. Cl.
CPC ..... *G03G 9/08797* (2013.01); *G03G 9/081* (2013.01); *G03G 9/08755* (2013.01); *G03G 9/08782* (2013.01); *G03G 9/08795* (2013.01)

(58) Field of Classification Search
CPC ..... G03G 9/08755; G03G 9/08797; G03G 9/08795
USPC ..... 430/109.4, 111.4
See application file for complete search history.

(56) References Cited

U.S. PATENT DOCUMENTS

| | | | | |
|---|---|---|---|---|
| 7,723,002 | B2 | 5/2010 | Shimokusa et al. | |
| 10,209,640 | B2 * | 2/2019 | Okita | G03G 9/09314 |
| 2005/0095523 | A1 | 5/2005 | Shimokusa et al. | |

FOREIGN PATENT DOCUMENTS

| | | | |
|---|---|---|---|
| JP | 2005-266753 | A | 9/2005 |

* cited by examiner

*Primary Examiner* — Mark A Chapman
(74) *Attorney, Agent, or Firm* — Studebaker & Brackett PC

(57) ABSTRACT

A positively chargeable toner includes a plurality of toner particles. The toner particles each contain a crystalline polyester resin, a non-crystalline polyester resin, a carnauba wax, and a quaternary ammonium salt. The crystalline polyester resin has an SP value of at least 10.0 $(cal/cm^3)^{1/2}$ and no greater than 10.1 $(cal/cm^3)^{1/2}$. An amount of the crystalline polyester resin is at least 5 parts by mass and no greater than 19 parts by mass relative to 100 parts by mass of the toner particles. An amount of the carnauba wax is at least 21.0% by mass and no greater than 42.0% by mass relative to a total mass of the crystalline polyester resin, the quaternary ammonium salt, and the carnauba wax.

4 Claims, No Drawings

POSITIVELY CHARGEABLE TONER

INCORPORATION BY REFERENCE

The present application claims priority under 35 U.S.C. § 119 to Japanese Patent Application No. 2017-218729, filed on Nov. 14, 2017. The contents of this application are incorporated herein by reference in their entirety.

BACKGROUND

The present disclosure relates to a positively chargeable toner.

A known toner contains a crystalline polyester resin and a non-crystalline polyester resin.

SUMMARY

A positively chargeable toner according to the present disclosure includes a plurality of toner particles. The toner particles each contain a crystalline polyester resin, a non-crystalline polyester resin, a carnauba wax, and a quaternary ammonium salt. The crystalline polyester resin has an SP value of at least 10.0 $(cal/cm^3)^{1/2}$ and no greater than 10.1 $(cal/cm^3)^{1/2}$. An amount of the crystalline polyester resin is at least 5 parts by mass and no greater than 19 parts by mass relative to 100 parts by mass of the toner particles. An amount of the carnauba wax is at least 21.0% by mass and no greater than 42.0% by mass relative to a total mass of the crystalline polyester resin, the quaternary ammonium salt, and the carnauba wax.

DETAILED DESCRIPTION

The following describes an embodiment of the present disclosure. A toner is a mass of toner particles. Note that evaluation results (values indicating shape, physical properties, or the like) for a powder are each a number average of values measured for a suitable number of particles selected from the powder, unless otherwise stated. Examples of powders include toner mother particles, an external additive, and a toner. The term "toner mother particle" refers to a toner particle including no external additive.

A number average particle diameter of a powder is a number average value of equivalent circle diameters (diameters of circles having the same areas as projected areas of particles) of primary particles measured using a microscope, unless otherwise stated. A measured value for a volume median diameter ($D_{50}$) of a powder is a value measured based on the Coulter principle (electrical sensing zone method) using "COULTER COUNTER MULTISIZER 3" manufactured by Beckman Coulter, Inc., unless otherwise stated.

A measured value for an acid value and a measured value for a hydroxyl value are values measured in accordance with "Japanese Industrial Standard (JIS) K0070-1992", unless otherwise stated. A measured value for a number average molecular weight (Mn) and a measured value for a mass average molecular weight (Mw) are values measured by gel permeation chromatography, unless otherwise stated. A glass transition point (Tg) and a melting point (Mp) are measured using a differential scanning calorimeter ("DSC-6220" manufactured by Seiko Instruments Inc.), unless otherwise stated. A softening point (Tm) is measured using a capillary rheometer ("CFT-500D" manufactured by Shimadzu Corporation), unless otherwise stated.

The term "crystalline polyester resin" refers to a polyester resin having a crystallinity index of at least 0.90 and no greater than 1.30. Preferably, the crystallinity index of the crystalline polyester resin is at least 0.98 and no greater than 1.15. The crystallinity index of a resin is equivalent to a ratio (=Tm/Mp) of the softening point (Tm) of the resin to the melting point (Mp) of the resin. The crystallinity index of the crystalline polyester resin can be adjusted by changing materials for synthesizing the crystalline polyester resin or amounts (blend ratio) of the materials. Toner particles may contain only a single crystalline polyester resin or two or more crystalline polyester resins. Note that a definite melting point (Mp) cannot be measured for a non-crystalline polyester resin in many cases.

An SP value (solubility parameter) referred to herein is a value calculated by the Fedors method (temperature: 25° C.). An SP value calculated by the Fedors method is represented by an expression "SP value=$(E/V)^{1/2}$". In this expression, E represents a molecular cohesive energy [cal/mol] and V represents a molar molecular volume [$cm^3$/mol] of a solvent. Note that details of the Fedors method are described in the following document A.

Document A: R. F. Fedors, "Polymer Engineering and Science", 1974, vol. 14, No. 2, pp. 147-154.

In the following description, the term "-based" may be appended to the name of a chemical compound to form a generic name encompassing both the chemical compound and derivatives thereof. When the term "-based" is appended to the name of a chemical compound used in the name of a polymer, the term indicates that a repeating unit of the polymer originates from the chemical compound or a derivative thereof. Also, the term "(meth)acryl" may be used as a generic term encompassing both acryl and methacryl.

Strength of chargeability refers to strength of chargeability in triboelectric charging, unless otherwise stated. A toner can be triboelectrically charged for example through mixing and stirring of the toner with a standard carrier (anionic property: N-01, cationic property: P-01) provided by The Imaging Society of Japan. Surface potentials of toner particles are measured using for example a kelvin probe force microscope (KFM) before and after triboelectric charging. A portion having a larger difference in the surface potential between before and after the triboelectric charging has stronger chargeability.

A positively chargeable toner excellent in charge stability means a positively chargeable toner having the following first through third features. The first feature is that the positively chargeable toner has a sharp charge distribution. The second feature is that an amount of charge of the positively chargeable toner can be maintained at a desired amount of charge at a start of image formation with the positively chargeable toner. The third characteristic is that an amount of charge of the positively chargeable toner can be maintained at a desired amount of charge in continuous image formation with the positively chargeable toner.

A positively chargeable toner according to the present embodiment is an electrostatic latent image developing toner favorably usable for development of electrostatic latent images. The positively chargeable toner according to the present embodiment may constitute a one-component developer or compose a two-component developer with a carrier. When the positively chargeable toner constitutes a one-component developer, the positively chargeable toner is positively charged through friction with a development sleeve or a toner charging member in a development device. An example of the toner charging member is a doctor blade. When the positively chargeable toner composes a two-component developer, the positively chargeable toner is positively charged through friction with a carrier in the development device.

The positively chargeable toner according to the present embodiment is usable for image formation for example in an electrophotographic apparatus (image forming apparatus). The following describes an example of image forming methods using an electrophotographic apparatus.

First, an electrostatic latent image is formed on a photosensitive layer of a photosensitive drum on the basis of image data. Next, the formed electrostatic latent image is developed with a positively chargeable toner (development process). In the development process, a development device supplies the positively chargeable toner on a development sleeve to the photosensitive layer of the photosensitive drum so that the positively chargeable toner is attached to the electrostatic latent image by electrical force. Thus, the electrostatic latent image is developed to form a toner image on the photosensitive layer of the photosensitive drum. Subsequently, the toner image is transferred to a recording medium (for example, paper), and then the unfixed toner image is fixed to the recording medium through heating. As a result, an image is formed on the recording medium.

[Basic Features of Positively Chargeable Toner]

The positively chargeable toner according to the present embodiment has the following features (hereinafter may be referred to as "basic features"). Specifically, the positively chargeable toner according to the present embodiment includes a plurality of toner particles. The toner particles each contain a crystalline polyester resin, a non-crystalline polyester resin, a carnauba wax, and a quaternary ammonium salt. The crystalline polyester resin has an SP value of at least 10.0 $(cal/cm^3)^{1/2}$ and no greater than 10.1 $(cal/cm^3)^{1/2}$. An amount of the crystalline polyester resin is at least 5 parts by mass and no greater than 19 parts by mass relative to 100 parts by mass of the toner particles. An amount of the carnauba wax is at least 21.0% by mass and no greater than 42.0% by mass relative to a total mass of the crystalline polyester resin, the quaternary ammonium salt, and the carnauba wax.

The crystalline polyester resin contained in the positively chargeable toner according to the present embodiment has an SP value of at least 10.0 $(cal/cm^3)^{1/2}$ and no greater than 10.1 $(cal/cm^3)^{1/2}$. Therefore, the positively chargeable toner is excellent in low-temperature fixability and heat-resistant preservation stability. Also, the positively chargeable toner can have improved hot offset resistance. An excessively small SP value of the crystalline polyester resin may result in decrease in low-temperature fixability of the positively chargeable toner. An excessively large SP value of the crystalline polyester resin may result in decrease in heat-resistant preservation stability of the positively chargeable toner. An excessively large SP value of the crystalline polyester resin may also result in decrease in hot offset resistance of the positively chargeable toner. In the following description, the "crystalline polyester resin having an SP value of at least 10.0 $(cal/cm^3)^{1/2}$ and no greater than 10.1 $(cal/cm^3)^{1/2}$" will be referred to as a "crystalline polyester resin X".

The amount of the crystalline polyester resin X contained in the positively chargeable toner according to the present embodiment is at least 5 parts by mass and no greater than 19 parts by mass relative to 100 parts by mass of the toner particles. For also this reason, the positively chargeable toner is excellent in low-temperature fixability and heat-resistant preservation stability. Also, the positively chargeable toner can have improved hot offset resistance. In the following description, the "amount of the crystalline polyester resin X relative to 100 parts by mass of the toner particles" will be referred to as an "amount of the crystalline polyester resin X". An excessively small amount of the crystalline polyester resin X may result in decrease in low-temperature fixability of the positively chargeable toner. An excessively large amount of the crystalline polyester resin X may result in decrease in heat-resistant preservation stability of the positively chargeable toner. An excessively large amount of the crystalline polyester resin X may also result in decrease in hot offset resistance of the positively chargeable toner.

The toner particles of the positively chargeable toner according to the present embodiment contain not only the crystalline polyester resin X but also the quaternary ammonium salt and the carnauba wax. Furthermore, the amount of the carnauba wax is at least 21.0% by mass and no greater than 42.0% by mass relative to a total mass of the crystalline polyester resin X, the quaternary ammonium salt, and the carnauba wax. Therefore, the positively chargeable toner is excellent not only in low-temperature fixability and heat-resistant preservation stability but also in charge stability. The following gives detailed description.

Specifically, use of a positively chargeable charge control agent is for example proposed for the purpose of improving charge stability of the positively chargeable toner. Examples of known positively chargeable charge control agents include nigrosine and quaternary ammonium salts. Nigrosine has a black color. Accordingly, nigrosine is suitably usable for black toner, but is difficult to be used for a non-black toner other than the black toner. By contrast, a quaternary ammonium salt hardly has any color. Accordingly, the quaternary ammonium salt can be suitably used for non-black toners other than the black toner. In view of the above, the present inventor anticipated that a positively chargeable toner excellent not only in low-temperature fixability and heat-resistant preservation stability but also in charge stability would be obtained through use of the crystalline polyester resin X and the quaternary ammonium salt.

However, in production of a positively chargeable toner with the crystalline polyester resin X and the quaternary ammonium salt, compatibilization between the crystalline polyester resin X and the quaternary ammonium salt occurred resulting in decrease in charge stability of the positively chargeable toner. The present inventor inferred reasons for the above result as follows. Specifically, functioning of the quaternary ammonium salt degrades as a result of compatibilization between the crystalline polyester resin X and the quaternary ammonium salt. When the functioning of the quaternary ammonium salt degrades, an amount of charge of the positively chargeable toner is difficult to be maintained, resulting in decrease in charge stability of the positively chargeable toner.

Based on the above consideration, the present inventor made intensive study on a method for preventing compatibilization between the crystalline polyester resin X and the quaternary ammonium salt. As a result, it was found that compatibilization between the crystalline polyester resin X and the quaternary ammonium salt can be prevented through adjustment of the amount of the carnauba wax. Specifically, it was found that in a configuration in which the amount of the carnauba wax is at least 21.0% by mass and no greater than 42.0% by mass relative to a total mass of the crystalline polyester resin X, the quaternary ammonium salt, and the carnauba wax, compatibilization between the crystalline polyester resin X and the quaternary ammonium salt can be effectively prevented. Prevention of compatibilization between the crystalline polyester resin X and the quaternary ammonium salt can result in prevention of degradation of the functioning of the quaternary ammonium salt, resulting in increase in charge stability of the positively chargeable toner. In the following description, the "amount of the carnauba wax relative to a total mass of the crystalline polyester resin X, the quaternary ammonium salt, and the carnauba wax" will be referred to as an "amount ratio of the carnauba wax".

An excessively low amount ratio of the carnauba wax may result in failure of prevention of compatibilization between the crystalline polyester resin X and the quaternary ammonium salt. As a result, charge stability of the positively chargeable toner may decrease. An excessively high amount ratio of the carnauba wax may result in compatibilization between the crystalline polyester resin X and the carnauba wax, resulting in decrease in crystallinity of the crystalline polyester resin X. Decrease in crystallinity of the crystalline polyester resin X may result in decrease in heat-resistant preservation stability of the positively chargeable toner. The amount ratio of the carnauba wax is preferably at least 25.0% by mass and no greater than 35.0% by mass, and more preferably at least 28.0% by mass and no greater than 32.0% by mass.

Note that the amount ratio of the carnauba wax can be determined by the following method. Specifically, an amount of the crystalline polyester resin X, an amount of the quaternary ammonium salt, and an amount of the carnauba wax are determined through analysis of the positively chargeable toner by a specific method. The amount ratio of the carnauba wax is calculated based on the respective determined amounts. The amount of the carnauba wax can be determined for example by the following method.

First, it is confirmed that the positively chargeable toner contains the carnauba wax by infrared analysis or gas chromatography-mass spectrometry (GC/MS method). Next, a heat absorption curve of the toner [vertical axis: heat flow (DSC signal), horizontal axis: temperature] is plotted by differential scanning calorimetry. Based on the plotted heat absorption curve of the toner and the melting point (literature value) of the carnauba wax, an endothermic peak derived from the carnauba wax (carnauba wax contained in the positively chargeable toner) is identified from among two or more endothermic peaks included in the heat absorption curve. An endotherm quantity of the carnauba wax is determined based on the identified endothermic peak. The amount of the carnauba wax is determined based on the determined endotherm quantity of the carnauba wax. The amount of the carnauba wax can be determined as described above. The amount of the carnauba wax may be determined by the GC/MS method. More specifically, a quantitative analysis by the GC/MS method may be performed using a calibration curve plotted for standard samples. Carnauba waxes can be used as the standard samples.

The toner particles of the positively chargeable toner according to the present embodiment contain not only the crystalline polyester resin X but also the non-crystalline polyester resin. A non-crystalline polyester resin typically has an SP value of at least 9.0 $(cal/cm^3)^{1/2}$ and no greater than 12.0 $(cal/cm^3)^{1/2}$. Therefore, in the positively chargeable toner according to the present embodiment, a difference between the SP value of the crystalline polyester resin X and the SP value of the non-crystalline polyester resin can be made relatively small. Accordingly, sufficient compatibility between the crystalline polyester resin X and the non-crystalline polyester resin can be easily ensured. Preferably, the SP value of the non-crystalline polyester resin is at least 10.5 $(cal/cm^3)^{1/2}$ and no greater than 10.8 $(cal/cm^3)^{1/2}$. Also, offset resistance of the positively chargeable toner can be improved through the toner particles containing the non-crystalline polyester resin.

[Examples of Materials of Positively Chargeable Toner]

The positively chargeable toner includes a plurality of toner particles. The toner particles each contain a binder resin, a releasing agent, and a charge control agent. The toner particles may each further contain a colorant.

The toner particles may include an external additive. In a configuration in which the toner particles include the external additive, toner mother particles contain the binder resin, the releasing agent, and the charge control agent. The following describes specific materials of the positively chargeable toner in a configuration in which the toner particles include the external additive.

<Toner Mother Particles>

(Binder Resin)

The binder resin is typically a main component (for example, at least 85% by mass) of the toner mother particles. Therefore, properties of the binder resin are thought to have great influence on overall properties of the toner mother particles. The binder resin includes polyester resins, more specifically, the crystalline polyester resin X and the non-crystalline polyester resin.

(Polyester Resin)

A polyester resin is a polymer of a monomer mixture including at least one alcohol and at least one carboxylic acid. Examples of alcohols that can be used for synthesis of the polyester resin include dihydric alcohols and tri- or higher-hydric alcohols listed below. Examples of dihydric alcohols that can be used include diols and bisphenols. Examples of carboxylic acids that can be used for synthesis of the polyester resin include dibasic carboxylic acids and tri- or higher-basic carboxylic acids listed below.

Examples of preferable diols include aliphatic diols. Examples of preferable aliphatic diols include diethylene glycol, triethylene glycol, neopentyl glycol, 1,2-propanediol, α,ω-alkanediols, 2-butene-1,4-diol, 1,4-cyclohexanedimethanol, dipropylene glycol, polyethylene glycol, polypropylene glycol, and polytetramethylene glycol. Examples of preferable α,ω-alkanediols include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids, α,ω-alkanedicarboxylic acids, unsaturated dicarboxylic acids, and cycloalkane dicarboxylic acids. Examples of preferable aromatic dicarboxylic acids include phthalic acid, terephthalic acid, and isophthalic acid. Examples of preferable α,ω-alkanedicarboxylic acids include malonic acid, succinic acid, succinic anhydride, succinic acid derivatives, adipic acid, suberic acid, azelaic acid, sebacic acid, and 1,10-decanedicarboxylic acid. Examples preferable succinic acid derivatives include alkyl succinic acids and alkenyl succinic acids. Examples of preferable alkyl succinic acids include n-butylsuccinic acid, isobutylsuccinic acid, n-octylsuccinic acid, n-dodecylsuccinic acid, and isododecylsuccinic acid. Anhydrides of these acids are included in the alkyl succinic acids. Examples of preferable alkenyl succinic acids include n-butenylsuccinic acid, isobutenylsuccinic acid, n-octenylsuccinic acid, n-dodecenylsuccinic acid, and isododecenylsuccinic acid. Anhydrides of these acids are included in the alkenyl succinic acids. Examples of preferable unsaturated dicarboxylic acids include maleic acid, fumaric acid, citraconic acid, itaconic acid, and glutaconic acid. Examples of preferable cycloalkane dicarboxylic acids include cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Crystalline Polyester Resin X)

The crystalline polyester resin X is synthesized using at least one alcohol that preferably includes an aliphatic diol having a carbon number of at least 2 and no greater than 8, and more preferably an α,ω-alkanediol having a carbon number of at least 2 and no greater than 8. Preferably, the at least one alcohol includes two α,ω-alkanediols. More specifically, the at least one alcohol preferably includes 1,4-butanediol (carbon number: 4) and 1,6-hexanediol (carbon number: 6) as the two α,ω-alkanediols.

The crystalline polyester resin X is synthesized using at least one carboxylic acid that preferably includes an aliphatic dicarboxylic acid having a carbon number (the number of carbon atoms including carbon atoms included in two carboxyl groups) of at least 4 and no greater than 8, for example. The aliphatic dicarboxylic acid having a carbon number of at least 4 and no greater than 8 is preferably an alkene dicarboxylic acid having a carbon number of at least 4 and no greater than 8, and more preferably fumaric acid (carbon number: 4). The alkene dicarboxylic acid having a carbon number of at least 4 and no greater than 8 is an alkene having a carbon number of at least 2 and no greater than 6 and substituted with two carboxyl groups.

More preferably, the at least one carboxylic acid used for synthesis of the crystalline polyester resin X does not include a carboxylic acid having a carbon number of at least 10 (for example, sebacic acid). In this configuration, the resultant crystalline polyester resin tends to have an SP value of at least 10.0 $(cal/cm^3)^{1/2}$ and no greater than 10.1 $(cal/cm^3)^{1/2}$ Therefore, a positively chargeable toner that is more excellent in low-temperature fixability and heat-resistant preservation stability can be obtained.

Preferably, the crystalline polyester resin X has a melting point (Mp) of at least 50.0° C. and no higher than 100.0° C. In this configuration, a positively chargeable toner that is more excellent in low-temperature fixability and heat-resistant preservation stability can be obtained. More preferably, the crystalline polyester resin X has a melting point (Mp) of at least 78.0° C. and no higher than 90.0° C.

The crystalline polyester resin X preferably has a softening point (Tm) of no higher than 88.7° C., and more preferably at least 88.0° C. and no higher than 88.7° C.

The crystalline polyester resin X preferably has an acid value of no greater than 3.0 mgKOH/g, and more preferably at least 1.0 mgKOH/g and no greater than 3.0 mgKOH/g. The crystalline polyester resin X preferably has a hydroxyl value of no greater than 10.0 mgKOH/g, and more preferably at least 5.0 mgKOH/g and no greater than 10.0 mgKOH/g. Alternatively, the crystalline polyester resin X preferably has a hydroxyl value of at least 20.0 mgKOH/g, and more preferably at least 20.0 mgKOH/g and no greater than 50.0 mgKOH/g.

The crystalline polyester resin X preferably has a mass average molecular weight of no greater than 10,000, and more preferably at least 5,000 and no greater than 10,000. Alternatively, the crystalline polyester resin X preferably has a mass average molecular weight of at least 23,000, and more preferably at least 23,000 and no greater than 30,000. The crystalline polyester resin X preferably has a number average molecular weight of greater than 3,500, and more preferably at least 3,600 and no greater than 3,700.

Preferably, the amount of the crystalline polyester resin X contained in the toner mother particles at least 5.0% by mass and no greater than 19.0% by mass relative to a total amount of polyester resins contained in the toner mother particles. In this configuration, a positively chargeable toner that is more excellent in low-temperature fixability and heat-resistant preservation stability can be obtained. More preferably, the amount of the crystalline polyester resin X contained in the toner mother particles is at least 6.5% by mass and no greater than 19.0% by mass relative to the total amount of the polyester resins contained in the toner mother particles. The total amount of the polyester resins contained in the toner mother particles means a sum of the amount of the crystalline polyester resin X and the amount of the non-crystalline polyester resin.

The crystalline polyester resin X may further include a constitutional unit derived from a monomer (additional monomer) other than the at least one alcohol and the at least one carboxylic acid. More specifically, the crystalline polyester resin X may be a copolymer of the at least one alcohol and the at least one carboxylic acid or a copolymer of the at least one alcohol, the at least one carboxylic acid, and at least one additional monomer. Preferably, the additional monomer is at least one monomer selected from the group consisting of styrene-based monomers and acrylic acid-based monomers.

Examples of preferable styrene-based monomers include styrene, alkyl styrenes, hydroxystyrenes, and halogenated styrenes. Examples of preferable alkyl styrenes include α-methylstyrene, o-methylstyrene, m-methylstyrene, p-methylstyrene, p-ethylstyrene, and 4-tert-butylstyrene. Examples of preferable hydroxystyrenes include p-hydroxystyrene and m-hydroxystyrene. Examples of preferable halogenated styrenes include α-chlorostyrene, o-chlorostyrene, m-chlorostyrene, and p-chlorostyrene.

Examples of preferable acrylic acid-based monomers include (meth)acrylic acid, (meth)acrylonitrile, (meth) acrylic acid alkyl esters, and (meth)acrylic acid hydroxyalkyl esters. Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

(Non-crystalline Polyester Resin)

The non-crystalline polyester resin is synthesized using at least one alcohol that preferably includes a bisphenol. Preferably, at least one of bisphenol A ethylene oxide adducts and bisphenol A propylene oxide adducts is included as the bisphenol.

The non-crystalline polyester resin is synthesized using at least one carboxylic acid preferably selected from the group consisting of tri- or higher-basic carboxylic acids, alkenyl succinic acids, and unsaturated dicarboxylic acids. Examples of preferable tri- or higher-basic carboxylic acids include trimellitic acid. Examples of preferable alkenyl succinic acids include an anhydride of n-dodecenylsuccinic acid. Examples of preferable unsaturated dicarboxylic acids include fumaric acid. The amount of one or more tri- or higher-basic carboxylic acids used for synthesis of the non-crystalline polyester resin is preferably at least 1 mol % and no greater than 20 mol % relative to a total amount of the at least one carboxylic acid used for synthesis of the non-crystalline polyester resin, and more preferably at least 5 mol % and no greater than 20 mol %. The total amount of the at least one carboxylic acid used for synthesis of the non-crystalline polyester resin means a sum of the amount of one or more tri- or higher-basic carboxylic acids, the amount of one or more alkenyl succinic acids, and the amount of one or more unsaturated dicarboxylic acids.

(Additional Resin)

Properties of the binder resin (specifically, a hydroxyl value, an acid value, a glass transition point, and a softening point) can be adjusted through use of a combination of different resins as the binder resin. For example, when the binder resin has an ester group, a hydroxyl group, an ether group, an acid group, or a methyl group, the toner mother particles have a strong tendency to be anionic.

The binder resin may further include a thermoplastic resin (additional thermoplastic resin) other than the crystalline polyester resin X and the non-crystalline polyester resin. Examples of preferable additional thermoplastic resins include styrene-based resins, acrylic acid-based resins, styrene-acrylic acid-based resins, olefin-based resins, vinyl resins, polyamide resins, and urethane resins. Examples of styrene-based monomers that can be used for synthesis of styrene-based resins include the styrene-based monomers listed above in (Crystalline Polyester Resin X). Examples of acrylic acid-based monomers that can be used for synthesis of acrylic acid-based resins include the acrylic acid-based monomers listed above in (Crystalline Polyester Resin X). Examples of olefin-based resins that can be used include polyethylene resins and polypropylene resins. Examples of vinyl resins that can be used include vinyl chloride resins, polyvinyl alcohols, vinyl ether resins, and N-vinyl resins. Also, copolymers of the above-listed resins, that is, any copolymers obtained through incorporation of a constitutional unit into the above-listed resins can be used as the additional thermoplastic resin. For example, styrene-butadiene-based resins can also be used as the additional thermoplastic resin.

(Releasing Agent)

The releasing agent is used for example in order to obtain a positively chargeable toner excellent in fixability and offset resistance. The releasing agent includes the carnauba wax.

A compatibilizer may be added to the toner mother particles in order to improve compatibility between the binder resin and the releasing agent.

(Charge Control Agent)

The charge control agent is used for example in order to obtain a positively chargeable toner excellent in charge stability and a charge rise characteristic. The charge rise characteristic of the positively chargeable toner is an indicator as to whether or not the positively chargeable toner can be charged to a specific charge level in a short period of time. Cationic strength of the toner mother particles can be increased through inclusion of a positively chargeable charge control agent in the toner mother particles. The charge control agent includes the quaternary ammonium salt.

Preferably, the amount of the charge control agent is at least 0.1 parts by mass and no greater than 5.0 parts by mass relative to 100 parts by mass of the binder resin.

(Colorant)

A known pigment or dye that matches the color of the positively chargeable toner can be used as the colorant. In order to form high-quality images with the positively chargeable toner, the amount of the colorant is preferably at least 1 part by mass and no greater than 20 parts by mass relative to 100 parts by mass of the binder resin.

The toner mother particles may contain a black colorant. Carbon black is an example of the black colorant. Alternatively, the black colorant may be a colorant adjusted to a black color using a yellow colorant, a magenta colorant, and a cyan colorant.

The toner mother particles may contain a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be used include C.I. Pigment Blue (1, 7, 15, 15:1, 15:2, 15:3, 15:4, 60, 62, or 66), Phthalocyanine Blue, C.I. Vat Blue, and C.I. Acid Blue.

<External Additive>

The external additive is used for example in order to obtain a positively chargeable toner excellent in fluidity and a handling property. Preferably, the amount of the external additive is at least 0.5 parts by mass and no greater than 10.0 parts by mass relative to 100 parts by mass of the toner mother particles.

Preferably, the external additive includes a plurality of external additive particles. Preferably, the external additive particles have a particle diameter of at least 10 nm and no greater than 1,000 nm. Preferably, the external additive particles are silica particles or particles of a metal oxide. Examples of preferable metal oxides include alumina, titanium oxide, magnesium oxide, zinc oxide, strontium titanate, and barium titanate.

[Preferable Method for Producing Positively Chargeable Toner]

The following describes a preferable method for producing the positively chargeable toner in a configuration in which the toner particles include the external additive. Note that toner particles produced at the same time are thought to have substantially the same structure as one another.

First, toner mother particles are produced by a known aggregation method or a known pulverization method. Through the above, the toner mother particles can be easily produced. Next, the toner mother particles and the external additive are mixed using a mixer (for example, an FM mixer manufactured by Nippon Coke & Engineering Co., Ltd.). Through the above, the external additive is physically connected to surfaces of the toner mother particles. Thus, the positively chargeable toner according to the present embodiment can be obtained.

EXAMPLES

The following describes examples of the present disclosure. Table 1 shows compositions of toners (electrostatic latent image developing toners) TA-1 to TA-9 and TB-1 to TB-9 according to Examples and Comparative Examples. In Table 1, "PES resin" represents polyester resin. "W-1" in the column titled "Releasing agent" represents a carnauba wax ("CARNAUBA WAX No. 1" manufactured by S. Kato & Co.). "W-2" in the column titled "Releasing agent" represents an ester wax ("NISSAN ELECTOL (registered Japanese trademark) WEP-3" manufactured by NOF Corporation).

TABLE 1

| | Crystalline PES resin | | Non-crystalline PES resin | | Releasing agent | | Charge control agent |
|---|---|---|---|---|---|---|---|
| Toner | Type | Amount (parts by mass) | Type | Amount (parts by mass) | Type | Amount (parts by mass) | Amount (parts by mass) |
| TA-1 | A | 10.0 | a | 80.0 | W-1 | 5.0 | 1.0 |
| TA-2 | B | 10.0 | a | 80.0 | W-1 | 5.0 | 1.0 |
| TA-3 | A | 6.0 | a | 84.0 | W-1 | 5.0 | 1.0 |
| TA-4 | A | 9.5 | a | 78.0 | W-1 | 7.5 | 1.0 |
| TA-5 | A | 17.0 | a | 73.0 | W-1 | 5.0 | 1.0 |
| TA-6 | A | 10.0 | a | 82.0 | W-1 | 3.0 | 1.0 |
| TA-7 | A | 10.0 | a | 80.5 | W-1 | 5.0 | 0.5 |
| TA-8 | A | 10.0 | a | 79.5 | W-1 | 5.0 | 1.5 |
| TA-9 | A | 10.0 | b | 80.0 | W-1 | 5.0 | 1.0 |
| TB-1 | C | 10.0 | a | 80.0 | W-1 | 5.0 | 1.0 |
| TB-2 | D | 10.0 | a | 80.0 | W-1 | 5.0 | 1.0 |
| TB-3 | A | 5.5 | a | 84.5 | W-1 | 5.0 | 1.0 |
| TB-4 | A | 9.5 | a | 77.5 | W-1 | 8.0 | 1.0 |
| TB-5 | A | 18.0 | a | 72.0 | W-1 | 5.0 | 1.0 |
| TB-6 | A | 11.0 | a | 81.0 | W-1 | 3.0 | 1.0 |
| TB-7 | A | 20.0 | a | 68.0 | W-1 | 7.0 | 1.0 |
| TB-8 | A | 4.0 | a | 87.5 | W-1 | 3.5 | 1.0 |
| TB-9 | A | 10.0 | a | 80.0 | W-2 | 5.0 | 1.0 |

Table 2 shows compositions and physical properties of crystalline polyester resins A to D. In Table 2. "1,4-BDO" represents 1,4-butanediol. "1,6-HDO" represents 1,6-hexanediol. "St" represents styrene. "MA" represents methacrylic acid. Mass average molecular weights of the crystalline polyester resins A to D are shown in the row titled "Mw". Number average molecular weights of the crystalline polyester resins A to D are shown in the row titled "Mn".

TABLE 2

| | | Crystalline polyester resin | | | |
|---|---|---|---|---|---|
| | | Resin A | Resin B | Resin C | Resin D |
| Amount | 1,4-BDO | 1,060 g (90.0 mol %) | 960 g (81.5 mol %) | 1,250 g (100.0 mol %) | 600 g (50.0 mol %) |
| | 1,6-HDO | 220 g (10.0 mol %) | 407 g (18.5 mol %) | 0 g (0.0 mol %) | 600 g (50.0 mol %) |
| | Fumaric acid | 1,480 g (100.0 mol %) | 1,480 g (100.0 mol %) | 300 g (30.0 mol %) | 0 g (0.0 mol %) |
| | Sebacic acid | 0 g (0.0 mol %) | 0 g (0.0 mol %) | 1,040 g (70.0 mol %) | 1,480 g (100.0 mol %) |
| | St | 0 g (0.0 mol %) | 138 g (56.0 mol %) | 138 g (56.0 mol %) | 138 g (56.0 mol %) |
| | MA | 0 g (0.0 mol %) | 108 g (44.0 mol %) | 108 g (44.0 mol %) | 108 g (44.0 mol %) |
| Physical property | Softening point (° C.) | 88.4 | 88.7 | 89.7 | 88.8 |
| | Melting point (° C.) | 85.0 | 78.5 | 77.4 | 70.5 |
| | Crystallinity index | 1.04 | 1.13 | 1.16 | 1.26 |
| | Acid value (mgKOH/g) | 1.0 | 3.0 | 3.5 | 3.9 |
| | Hydroxyl value (mgKOH/g) | 30.8 | 7.0 | 11.1 | 14.0 |
| | Mw | 7,400 | 24,000 | 18,000 | 22,000 |
| | Mn | 3,700 | 3,600 | 3,500 | 3,500 |
| | SP value | 10.0 | 10.1 | 10.2 | 9.9 |

Table 3 shows compositions and physical properties of non-crystalline polyester resins a and b. In Table 3, "BPA-PO" represents a bisphenol A propylene oxide adduct. "BPA-EO" represents a bisphenol A ethylene oxide adduct. Mass average molecular weights of the non-crystalline polyester resins a and b are shown in the row titled "Mw". Number average molecular weights of the non-crystalline polyester resins a and b are shown in the row titled "Mn".

TABLE 3

| | | Non-crystalline polyester resin | |
|---|---|---|---|
| | | Resin a | Resin b |
| Amount | BPA-PO | 1,500 g (100.0 mol %) | 1,200 g (85.0 mol %) |
| | BPA-EO | 0 g (0.0 mol %) | 145 g (15.0 mol %) |
| | Fumaric acid | 0 g (0.0 mol %) | 1,034 g (86.0 mol %) |
| | Anhydride of n-dodecenylsuccinic acid | 1,025 g (86.0 mol %) | 0 g (0.0 mol %) |
| | Trimellitic acid | 250 g (14.0 mol %) | 250 g (14.0 mol %) |
| Physical property | Softening point (° C.) | 142.2 | 138.2 |
| | Glass transition point (° C.) | 64.3 | 62.1 |
| | Acid value (mgKOH/g) | 14 | 29 |
| | Hydroxyl value (mgKOH/g) | 40 | 55 |
| | Mw | 53,702 | 64,500 |
| | Mn | 3,418 | 3,200 |
| | SP value | 10.5 | 10.8 |

The following describes methods for synthesizing binder resins used in Examples and Comparative Examples, and then describes methods for measuring physical property values of the resultant binder resins. Next, with respect to the toners according to Examples and Comparative Examples (more specifically, the toners TA-1 to TA-9 and TB-1 to TB-9), production methods, evaluation methods, and evaluation results will be described in order. Note that in evaluations in which errors might occur, a suitable number of measured values were obtained, and the arithmetic mean of the measured values was calculated as an evaluation value so that any errors were sufficiently small.

[Methods for Synthesizing Binder Resins]

<Synthesis of Crystalline Polyester Resin A>

A four-necked flask (capacity: 5 L) equipped with a thermometer (thermocouple), a drainage tube, a nitrogen inlet tube, and a stirrer was charged with 1,060 g of 1,4-butanediol, 220 g of 1,6-hexanediol, 1,480 g of fumaric acid, and 2.5 g of hydroquinone. An internal temperature of the flask was increased up to 170° C. at atmospheric pressure, and then kept at 170° C. for 5 hours. The flask contents reacted while the internal temperature of the flask was kept at 170° C. The internal temperature of the flask was increased up to 210° C. at the atmospheric pressure, and then kept at 210° C. for 1.5 hours. The flask contents further reacted while the internal temperature of the flask was kept at 210° C. The internal pressure of the flask was lowered to 8.0 kPa while the internal temperature of the flask was kept at 210° C. The internal temperature of the flask was kept at 210° C. and the internal pressure of the flask was kept at 8.0 kPa until the softening point of the flask contents became 88.4° C. Through the above, the crystalline polyester resin A was obtained.

<Synthesis of Crystalline Polyester Resin B>

A four-necked flask (capacity: 5 L) equipped with a thermometer (thermocouple), a drainage tube, a nitrogen inlet tube, and a stirrer was charged with 960 g of 1,4-butanediol, 187 g of 1,6-hexanediol, 1,480 g of fumaric acid, and 2.5 g of hydroquinone. An internal temperature of the flask was increased up to 170° C. at the atmospheric pressure, and then kept at 170° C. for 5 hours. The flask contents reacted while the internal temperature of the flask was kept at 170° C. The internal temperature of the flask was increased up to 210° C. at the atmospheric pressure, and then kept at 210° C. for 1.5 hours. The flask contents further reacted while the internal temperature of the flask was kept at 210° C. The internal pressure of the flask was lowered to 8.0 kPa while the internal temperature of the flask was kept at 210° C. The internal temperature of the flask was kept at 210° C. and the internal pressure of the flask was kept at 8.0 kPa for 1 hour Thereafter, the internal pressure of the flask was restored to the atmospheric pressure.

Then, 138 g of styrene and 108 g of methacrylic acid were added into the flask. The internal pressure of the flask was lowered to 8.0 kPa. The internal temperature of the flask was kept at 210° C. and the internal pressure of the flask was kept at 8.0 kPa until the softening point of the flask contents became 88.7° C. Through the above, the crystalline polyester resin B was obtained.

<Synthesis of Crystalline Polyester Resin C>

The amount of 1,4-butanediol was changed to 1,250 g. Further, 1,6-hexanediol was not added into the flask. That is, the amount of 1,6-hexanediol was changed to 0 g. The amount of fumaric acid was changed to 300 g. Also, 1,040 g of sebacic acid was added into the flask together with 300 g of fumaric acid. After styrene and methacrylic acid were added into the flask, the internal temperature of the flask was kept at 210° C. and the internal pressure of the flask was kept at 8.0 kPa until the softening point of the flask contents became 89.7° C. The crystalline polyester resin C was obtained by the same method as the method for synthesizing the crystalline polyester resin B in all aspects other than the above changes.

<Synthesis of Crystalline Polyester Resin D>

The amount of 1,4-butanediol was changed to 600 g. The amount of 1,6-hexanediol was changed to 600 g. Sebacic acid was used instead of fumaric acid. After styrene and methacrylic acid were added into the flask, the internal temperature of the flask was kept at 210° C. and the internal pressure of the flask was kept at 8.0 kPa until the softening point of the flask contents became 88.8° C. The crystalline polyester resin D was obtained by the same method as the method for synthesizing the crystalline polyester resin B in all aspects other than the above changes.

<Synthesis of Non-crystalline Polyester Resin a>

A four-necked flask (capacity: 5 L) equipped with a thermometer (thermocouple), a drainage tube, a nitrogen inlet tube, and a stirrer was charged with 1,500 g of a bisphenol A propylene oxide adduct, 900 g of an anhydride of n-dodecenylsuccinic acid, 250 g of trimellitic acid, and 4 g of dibutyltin oxide. An internal temperature of the flask was increased up to 220'C at the atmospheric pressure, and then kept at 220° C. for 9 hours. The flask contents reacted while the internal temperature of the flask was kept at 220° C. The internal pressure of the flask was lowered to 8.0 kPa while the internal temperature of the flask was kept at 220° C. The internal temperature of the flask was kept at 220° C. and the internal pressure of the flask was kept at 8.0 kPa until the softening point of the flask contents became 142.2° C. Through the above, the non-crystalline polyester resin a was obtained.

<Synthesis of Non-crystalline Polyester Resin b>

The amount of the bisphenol A propylene oxide adduct was changed to 1,200 g. Also, 145 g of a bisphenol A ethylene oxide adduct was added into the flask together with 1,200 g of the bisphenol A propylene oxide adduct. Further, 920 g of fumaric acid was added into the flask instead of 900 g of the anhydride of n-dodecenylsuccinic acid. The internal temperature of the flask was kept at 220° C. and the internal pressure of the flask was kept at 8.0 kPa until the softening point of the flask contents became 138.2° C. The non-crystalline polyester resin b was obtained by the same method as the method for synthesizing the non-crystalline polyester resin a in all aspects other than the above changes.

[Methods for Measuring Physical Property Values of Binder Resins]

<Measurement of Softening Point (Tm)>

A sample (more specifically, any of the crystalline polyester resins A to D and the non-crystalline polyester resins a and b) was set in a capillary rheometer ("CFT-500D" manufactured by Shimadzu Corporation). Then, melt-flow of 1 $cm^3$ of the sample was caused under conditions of: a die pore diameter of 1 mm; a plunger load of 20 $kg/cm^2$; and a heating rate of 6° C./minute. Through the above, an S-shaped curve (horizontal axis: temperature, vertical axis: stroke) was plotted. A softening point of the sample was read from the plotted S-shaped curve. A temperature at a point on the S-shaped curve at which the stroke value is "$(S_1+S_2)/2$" where $S_1$ represents a maximum stroke value and $S_2$ represents a base line stroke value at a low temperature side corresponds to the softening point of the sample. Measurement results are shown in Tables 2 and 3.

<Measurement of Melting Point (Mp)>

Approximately 15 mg of a sample (more specifically, any of the crystalline polyester resins A to D) was placed in an aluminum pan (aluminum container), and the aluminum pan was set in a measurement section of a differential scanning calorimeter ("DSC-6220" manufactured by Seiko Instruments Inc.). Also, an empty aluminum pan was used as a reference. In plotting a heat absorption curve, the temperature of the measurement section was increased from a measurement start temperature of 30° C. to 170° C. at a rate of 10° C./minute. In the heating, the heat absorption curve [vertical axis: heat flow (DSC signal), horizontal axis: temperature] of the sample was plotted. A melting point of the sample was read from the plotted heat absorption curve. A temperature at a maximum peak of the heat absorption curve due to heat of fusion corresponds to the melting point of the sample. Measurement results are shown in Table 2.

<Measurement of Glass Transition Point (Tg)>

Approximately 10 mg of a sample (more specifically, either of the non-crystalline polyester resins a and b) was placed in an aluminum pan (aluminum container), and the aluminum pan was set in a measurement section of a differential scanning calorimeter ("DSC-6220" manufactured by Seiko Instruments Inc.). Also, an empty aluminum pan was used as a reference. In plotting a heat absorption curve, the temperature of the measurement section was increased from a measurement start temperature of 25° C. to 200° C. at a rate of 10° C./minute (RUN 1). Thereafter, the temperature of the measurement section was lowered from 200° C. to 25° C. at a rate of 10° C./minute. Subsequently, the temperature of the measurement section was increased again from 25° C. to 200° C. at a rate of 10° C./minute (RUN 2). The heat absorption curve [vertical axis: heat flow (DSC signal), horizontal axis: temperature] of the sample was plotted in RUN 2. A glass transition point of the sample was read from the plotted heat absorption curve. A temperature (onset temperature) at a point of change in specific heat (an intersection point between an extrapolation of the base line and an extrapolation of an inclined portion of the curve) on the heat absorption curve corresponds to the glass transition point of the sample. Measurement results are shown in Table 3.

<Measurement of Acid Value and Hydroxyl Value>

An acid value and a hydroxyl value of a sample (more specifically, any of the crystalline polyester resins A to D and the non-crystalline polyester resins a and b) were measured in accordance with methods described in Japanese Industrial Standard (JIS) K0070-1992 (test methods for acid value, saponification value, ester value, iodine value, hydroxyl value, and unsaponifiable matter of chemical products). Measurement results are shown in Tables 2 and 3.

<Measurement of Mass Average Molecular Weight and Number Average Molecular Weight>

A mass average molecular weight and a number average molecular weight of a sample (more specifically, any of the crystalline polyester resins A to D and the non-crystalline polyester resins a and b) were measured by gel permeation chromatography. Measurement results are shown in Tables 2 and 3.

<Measurement of SP Value>

An SP value of a sample (more specifically, any of the crystalline polyester resins A to D and the non-crystalline polyester resins a and b) was determined by the Fedors method. Results are shown in Tables 2 and 3.

[Methods for Producing Toners]

<Production of Toner TA-1>

An FM mixer ("FM-20B" manufactured by Nippon Coke & Engineering Co., Ltd.) was charged with 80.0 parts by mass of the non-crystalline polyester resin a, 10.0 parts by mass of the crystalline polyester resin A, 5.0 parts by mass of a carnauba wax ("CARNAUBA WAX No. 1" manufactured by S. Kato & Co.), 1.0 part by mass of a charge control agent (quaternary ammonium salt: "BONTRON (registered Japanese trademark) P-51", manufactured by ORIENT CHEMICAL INDUSTRIES, Co., Ltd.), and 4.0 parts by mass of carbon black ("MA100" manufactured by Mitsubishi Chemical Corporation). The contents in the mixer were mixed at a rotational speed of 2,000 rpm for 4 minutes.

The resultant mixture was melt-kneaded using a twin-screw extruder ("PCM-30" manufactured by Ikegai Corp.) under conditions of: a material feeding rate of 6 kg/hour; a shaft rotational speed of 160 rpm; and a set temperature (cylinder temperature) of 120° C. The resultant melt-kneaded product was cooled. The cooled melt-kneaded product was coarsely pulverized using a pulverizer ("ROTOPLEX (registered Japanese trademark)" manufactured by Hosokawa Micron Corporation). The resultant coarsely pulverized product was finely pulverized using a pulverizer ("TURBO MILL TYPE RS" manufactured by FREUND-TURBO CORPORATION). The resultant finely pulverized product was classified using a classifier ("ELBOW JET TYPE EJ-LABO" manufactured by Nittetsu Mining Co., Ltd.). Through the above, toner mother particles having a volume median diameter ($D_{50}$) of 7 μm were obtained.

An FM mixer ("FM-10B" manufactured by Nippon Coke & Engineering Co., Ltd.) was charged with 100.0 parts by mass of the toner mother particles, 1.5 parts by mass of hydrophobic silica particles ("AEROSIL (registered Japanese trademark) RA-200H" manufactured by Nippon Aerosil Co., Ltd.), and 0.8 parts by mass of conductive titanium oxide particles ("EC-100" manufactured by Titan Kogyo, Ltd.). The contents in the mixer were mixed under conditions of: a rotational speed of 3,000 rpm: a jacket temperature of 20° C.; and a mixing time of 2 minutes. Through the above, the toner TA-1 including a number of toner particles was obtained.

<Production of Toners TA-2 to TA-9 and TB-1 to TB-9>

The toners TA-2 to TA-9 and TB-1 to TB-9 were each produced by the same method as the method for producing the toner TA-1 in all aspects other than that the type and the amount of the crystalline polyester resin, the type and the amount of the non-crystalline polyester resin, the type and the amount of the releasing agent, and the amount of the charge control agent were changed as shown in Table 1.

[Methods for Evaluating Toners]

<Evaluation of Low-Temperature Fixability of Toners>

First, 100 parts by mass of a carrier (carrier for "FS-C5250DN" manufactured by KYOCERA Document Solutions Inc.) and 10 parts by mass of a toner (more specifically, any of the toners TA-1 to TA-9 and TB-1 to TB-9) were mixed for 30 minutes using a ball mill. Through the above, a first evaluation target was obtained.

A printer ("FS-C5250DN" manufactured by KYOCERA Document Solutions Inc.) was modified to enable adjustment of a fixing temperature. The first evaluation target (unused) was loaded into a development device for black color included in the modified printer, and a toner for replenishment use (unused) was loaded into a toner container for black color included in the same printer. The toner for replenishment use used herein was the same toner as that included in the first evaluation target. A development bias of the modified printer was adjusted so that a toner application amount to printing paper became 1.0 mg/cm$^2$. Thus, a first evaluation apparatus was prepared.

A minimum fixing temperature was determined using the first evaluation apparatus. The minimum fixing temperature indicates the lowest temperature among fixing temperatures for which it was determined that cold offset had not occurred. Specifically, an unfixed solid image was formed on printing paper (more specifically, plain paper of A4 size) using the first evaluation apparatus in an environment at a temperature of 20° C. and a relative humidity of 65%. At that time, the development bias of the first evaluation apparatus was adjusted so that the toner application amount to the printing paper became 1.0 mg/cm$^2$.

The printing paper with the unfixed solid image formed thereon was passed through a fixing device of the first evaluation apparatus. At that time, the fixing temperature was increased from 110° C. in increments of 2° C. by increasing the temperature of the fixing device of the first evaluation apparatus (specifically, the surface temperature of a fixing roller included in the fixing device of the first evaluation apparatus) from 110° C. in increments of 2° C. Thus, solid images fixed at respective fixing temperatures were obtained.

Whether or not cold offset had occurred was determined through a fold-rubbing test performed using each of the obtained solid images. Specifically, the printing paper with the solid image fixed thereto was folded in half so that a surface of the printing paper with the solid image fixed thereto faced inward. A 1-kg weight covered with a cloth was rubbed back and forth on the fold of the printing paper five times. Thereafter, the printing paper was opened up, and a length of toner peeling (hereinafter referred to as a "peeling length") was measured in a part of the folded portion of the printing paper to which part the solid image had been fixed. When the peeling length was no longer than 1.0 mm, it was determined that cold offset had not occurred. When the peeling length was longer than 1.0 mm, it was determined that cold offset had occurred. Thus, the minimum fixing temperature was determined.

Low-temperature fixability of the toner was evaluated based on the minimum fixing temperature. The evaluation was performed in accordance with the following standards. Evaluation results are shown in Table 4.

Good: Minimum fixing temperature was equal to or lower than 145° C.

Bad: Minimum fixing temperature was higher than 145° C.

<Evaluation of Hot Offset Resistance of Toners>

An unfixed solid image was formed on printing paper by the method described above in <Evaluation of Low-temperature Fixability of Toners>. The temperature of the fixing device of the first evaluation apparatus (specifically, the surface temperature of the fixing roller included in the fixing device of the first evaluation apparatus) was set at 150° C., and the printing paper with the unfixed solid image formed thereon was passed through the fixing device of the first evaluation apparatus. The fixing roller was taken out of the first evaluation apparatus, and whether or not the toner had been attached to a circumferential surface of the fixing roller was visually checked. When the toner had not been attached to the circumferential surface of the fixing roller, the result was evaluated as acceptable. The temperature of the first evaluation apparatus was increased from 150° C. in increments of 2° C., and the highest temperature (maximum fixing temperature) among fixing temperatures for which the result was evaluated as acceptable was determined.

Hot offset resistance of the toner was evaluated based on the maximum fixing temperature. The evaluation was performed in accordance with the following standards. Evaluation results are shown in Table 4.

Good: Maximum fixing temperature was equal to or higher than 185° C.

Bad: Maximum fixing temperature was lower than 185° C.

<Evaluation of Releasability of Toners>

First, the fixing device was removed from the first evaluation apparatus, and then the fixing device was set to be driven independently of the first evaluation apparatus. A solid image (specifically, an unfixed solid image) was formed on printing paper using the first evaluation apparatus from which the fixing device had been removed. Then, the printing paper was cut such that a distance from the solid image to an end of the printing paper in a conveyance direction of the printing paper was 3 mm (i.e., a margin of 3 mm was left on the cut printing paper). The thus cut printing paper was taken to be evaluation paper. The evaluation paper was passed through the fixing device from the side of the margin by setting the temperature of the fixing device (specifically, the surface temperature of the fixing roller included in the fixing device) at 160° C., 170° C., and 180° C. Whether or not the evaluation paper had been wrapped around the fixing roller while being passed through the fixing device was checked. That is, whether or not paper jam had occurred was checked.

Evaluation was performed in accordance with the following standards. Evaluation results are shown in Table 5.

Good: The evaluation paper was not wrapped around the fixing roller.

Bad: The evaluation paper was wrapped around the fixing roller.

<Evaluation of Heat-resistant Preservation Stability of Toners>

First, 2 g of a toner (more specifically, any of the toners TA-1 to TA-9 and TB-1 to TB-9) was placed in a polyethylene container (capacity: 20 mL) and the container was sealed. The sealed container was left to stand in a thermostatic chamber (set temperature: 55° C.) for 3 hours. Thereafter, the container was taken out of the thermostatic chamber and cooled to room temperature (approximately 25° C.). Through the above, an evaluation toner was obtained.

The evaluation toner was placed on a 200-mesh sieve (pore size: 75 μm) of a known mass. A mass of the sieve including the evaluation toner was measured to determine a mass of the toner before sifting. The sieve was set in POWDER TESTER (registered Japanese trademark, manufactured by Hosokawa Micron Corporation) and shaken for 30 seconds at a rheostat level of 5 in accordance with a manual of POWDER TESTER to sift the evaluation toner. After the sifting, a mass of toner that had not passed through the sieve was measured. An agglomeration rate (unit: %) was determined from the mass of the toner before the sifting and the mass of the toner after the sifting based on the following equation. Note that in the following equation, "mass of toner after sifting" is the mass of the toner that did not pass through the sieve and remained on the sieve after the sifting.

Agglomeration rate=100×mass of toner after sifting/mass of toner before sifting

Heat-resistant preservation stability of the toner was evaluated based on the agglomeration rate. The evaluation was performed in accordance with the following standards. Evaluation results are shown in Table 5.

Good: Agglomeration rate was lower than 20%.

Bad: Agglomeration rate was equal to or higher than 20%.

<Evaluation of Charge Stability of Toners>

First, 100 parts by mass of a carrier (carrier for "FS-C5030N" manufactured by KYOCERA Document Solutions Inc.) and 10 parts by mass of a toner (more specifically, any of the toners TA-1 to TA-9 and TB-1 to TB-9) were mixed for 30 minutes using a ball mill. Through the above, a second evaluation target was obtained.

The second evaluation target (unused) was loaded into a development device for black color included in a printer ("FS-C5030N" manufactured by KYOCERA Document Solutions Inc.) and a toner for replenishment use (unused) was loaded into a toner container for black color included in the same printer. The toner for replenishment use used herein was the same toner as that included in the second evaluation target. A development bias of the printer was adjusted so that a toner application amount to printing paper became 0.4 mg/cm$^2$. Thus, a second evaluation apparatus was prepared.

An evaluation image was printed on printing paper (more specifically, plain paper of A4 size) using the second evaluation apparatus in an environment at a temperature of 20° C. and a relative humidity of 65%. The evaluation image included a solid image region and a blank region (region with no print thereon). A reflection density (ID: image density) of the solid image region of the evaluation image was measured using a Macbeth reflection densitometer ("RD914" manufactured by X-Rite Inc.). Thus, an initial image density was measured.

An image (printing rate: 5%) was continuously printed on 50,000 sheets of printing paper (more specifically, plain paper of A4 size) using the second evaluation apparatus in an environment at a temperature of 20° C. and a relative humidity of 65%. Thereafter, an evaluation image was printed on printing paper (more specifically, plain paper of A4 size) using the second evaluation apparatus. The evaluation image included a solid image region and a blank region (region with no print thereon). A reflection density (ID: image density) of the solid image region of the evaluation image was measured using a Macbeth reflection densitometer ("RD914", manufactured by X-Rite Inc.). Thus, an image density after continuous printing was measured.

Charge stability of the toner was evaluated based on each of the image densities. Evaluation was performed in accordance with the following standards.

Evaluation results are shown in Table 5.

Good: Image density was equal to or greater than 1.30.

Bad: Image density was smaller than 1.30.

[Evaluation Results of Toners]

Tables 4 and 5 show evaluation results of the toners (more specifically, the toners TA-1 to TA-9 and TB-1 to TB-9). In Table 4, amounts (unit: parts by mass) of respective crystalline polyester resins are shown in the column titled "Amount of resin". More specifically, the amounts (unit: parts by mass) of the respective crystalline polyester resins relative to 100 parts by mass of the toner particles are shown in the column titled "Amount of resin". Amount ratios (unit: % by mass) of respective carnauba waxes are shown in the column titled "Amount ratio of wax". More specifically, amount ratios (unit: % by mass) of the respective carnauba waxes determined by the following equation are shown in the column titled "Amount ratio of wax". Note that the toner TB-9 contained no carnauba wax. Accordingly, the amount ratio of a carnauba wax was not calculated for the toner TB-9.

Amount ratio (unit: % by mass) of carnauba wax=100×(amount of carnauba wax)/[(amount of crystalline polyester resin)+(amount of quaternary ammonium salt)+(amount of carnauba wax)]

In Table 5, evaluation results of releasability of the toners when the temperature of the fixing device (specifically, the surface temperature of the fixing roller included in the fixing device) was set at 160° C. are shown in the column titled "160° C.". Evaluation results of releasability of the toners when the temperature of the fixing device was set at 170° C. are shown in the column titled "170° C.". Evaluation results of releasability of the toners when the temperature of the fixing device was set at 180° C. are shown in the column titled "180° C.". Evaluation results of initial image densities are shown in the column titled "Initial". Evaluation results of image densities after the 50,000-sheet continuous printing are shown in the column titled "After continuous printing".

TABLE 4

| | Toner | Amount of resin (parts by mass) | Amount ratio of wax (% by mass) | Fixing temperature Minimum | Fixing temperature Maximum |
|---|---|---|---|---|---|
| Example 1 | TA-1 | 10.0 | 31.3 | 136° C./Good | 190° C./Good |
| Example 2 | TA-2 | 10.0 | 31.3 | 142° C./Good | 192° C./Good |
| Example 3 | TA-3 | 6.0 | 41.7 | 144° C./Good | 190° C./Good |

TABLE 4-continued

| | Toner | Amount of resin (parts by mass) | Amount ratio of wax (% by mass) | Fixing temperature Minimum | Fixing temperature Maximum |
|---|---|---|---|---|---|
| Example 4 | TA-4 | 9.5 | 41.7 | 138° C./Good | 198° C./Good |
| Example 5 | TA-5 | 17.0 | 21.7 | 124° C./Good | 188° C./Good |
| Example 6 | TA-6 | 10.0 | 21.4 | 140° C./Good | 186° C./Good |
| Example 7 | TA-7 | 10.0 | 32.3 | 136° C./Good | 192° C./Good |
| Example 8 | TA-8 | 9.6 | 30.3 | 136° C./Good | 194° C./Good |
| Example 9 | TA-9 | 10.0 | 31.3 | 138° C./Good | 192° C./Good |
| Comparative Example 1 | TB-1 | 10.0 | 31.3 | 132° C./Good | 184° C./Bad |
| Comparative Example 2 | TB-2 | 10.0 | 31.3 | 152° C./Bad | 194° C./Good |
| Comparative Example 3 | TB-3 | 5.5 | 43.5 | 144° C./Good | 190° C./Good |
| Comparative Example 4 | TB-4 | 9.7 | 43.2 | 132° C./Good | 196° C./Good |
| Comparative Example 5 | TB-5 | 18.0 | 20.8 | 122° C./Good | 184° C./Bad |
| Comparative Example 6 | TB-6 | 11.0 | 20.0 | 134° C./Good | 182° C./Bad |
| Comparative Example 7 | TB-7 | 20.0 | 25.0 | 118° C./Good | 176° C./Bad |
| Comparative Example 8 | TB-8 | 4.0 | 41.2 | 148° C./Bad | 188° C./Good |
| Comparative Example 9 | TB-9 | 10.0 | — | 134° C./Good | 194° C./Good |

TABLE 5

| | Toner | Agglomeration rate | Releasability 160° C. | Releasability 170° C. | Releasability 180° C. | Image density Initial | Image density After continuous printing |
|---|---|---|---|---|---|---|---|
| Example 1 | TA-1 | 10%/Good | Good | Good | Good | 1.41/Good | 1.39/Good |
| Example 2 | TA-2 | 12%/Good | Good | Good | Good | 1.44/Good | 1.40/Good |
| Example 3 | TA-3 | 15%/Good | Good | Good | Good | 1.43/Good | 1.39/Good |
| Example 4 | TA-4 | 17%/Good | Good | Good | Good | 1.42/Good | 1.35/Good |
| Example 5 | TA-5 | 19%/Good | Good | Good | Good | 1.32/Good | 1.30/Good |
| Example 6 | TA-6 | 11%/Good | Good | Good | Good | 1.34/Good | 1.32/Good |
| Example 7 | TA-7 | 10%/Good | Good | Good | Good | 1.38/Good | 1.35/Good |
| Example 8 | TA-8 | 10%/Good | Good | Good | Good | 1.46/Good | 1.43/Good |
| Example 9 | TA-9 | 14%/Good | Good | Good | Good | 1.40/Good | 1.38/Good |
| Comparative Example 1 | TB-1 | 33%/Bad | Good | Good | Good | 1.34/Good | 1.30/Good |
| Comparative Example 2 | TB-2 | 8%/Good | Good | Good | Good | 1.38/Good | 1.35/Good |
| Comparative Example 3 | TB-3 | 26%/Bad | Good | Good | Bad | 1.41/Good | 1.38/Good |
| Comparative Example 4 | TB-4 | 30%/Bad | Good | Bad | Bad | 1.39/Good | 1.34/Good |
| Comparative Example 5 | TB-5 | 23%/Bad | Good | Good | Good | 1.24/Bad | 1.18/Bad |
| Comparative Example 6 | TB-6 | 18%/Good | Good | Good | Bad | 1.29/Bad | 1.24/Bad |
| Comparative Example 7 | TB-7 | 28%/Bad | Good | Bad | Bad | 1.32/Good | 1.25/Bad |
| Comparative Example 8 | TB-8 | 20%/Bad | Good | Bad | Bad | 1.37/Good | 1.35/Good |
| Comparative Example 9 | TB-9 | 13%/Good | Good | Good | Good | 1.12/Bad | 1.08/Bad |

The toners TA-1 to TA-9 (toners according to Examples 1 to 9) each had the above-described basic features. Specifically, the toners TA-1 to TA-9 each included a plurality of toner particles. The toner particles each contained a crystalline polyester resin, a non-crystalline polyester resin, a carnauba wax, and a quaternary ammonium salt. The crystalline polyester resin had an SP value of at least 10.0 $(cal/cm^3)^{1/2}$ and no greater than 10.1 $(cal/cm^3)^{1/2}$. An amount of the crystalline polyester resin was at least 5 parts by mass and no greater than 19 parts by mass. An amount ratio of the carnauba wax was at least 21.0% by mass and no greater than 42.0% by mass.

As shown in Tables 4 and 5, with respect each of the toners TA-1 to TA-9, the minimum fixing temperature was equal to or lower than a desired value and the maximum fixing temperature was equal to or higher than a desired value. Even when each of the toners TA-1 to TA-9 was preserved at a high temperature for a specific period of time, the agglomeration rate could be controlled to be low. In image formation using any of the toners TA-1 to TA-9, it was confirmed that the evaluation paper had not been wrapped around the fixing roller even when the fixing temperature was set at 180° C. In image formation using any of the toners TA-1 to TA-9, the image density could be maintained to be equal to or higher than a desired value even after the continuous printing.

By contrast, the toners TB-1 to TB-9 did not have the above-described basic features. Specifically, the crystalline polyester resin contained in the toner TB-1 had an SP value of greater than 10.1 $(cal/cm^3)^{1/2}$. The maximum fixing temperature of the toner TB-1 was lower than the desired value. When the toner TB-1 was preserved at a high temperature for a specific period of time, the agglomeration rate became higher than those of the toners TA-1 to TA-9 preserved at the high temperature for the specific period of time.

The crystalline polyester resin contained in the toner TB-2 had an SP value of smaller than 10.0 $(cal/cm^3)^{1/2}$. The minimum fixing temperature of the toner TB-2 was higher than the desired value.

The amount ratio of the carnauba wax contained in the toner TB-3 was greater than 42.0% by mass. When the toner TB-3 was preserved at a high temperature for a specific period of time, the agglomeration rate became higher than those of the toners TA-1 to TA-9 preserved at the high temperature for the specific period of time. In image formation with the toner TB-3, the evaluation paper was wrapped around the fixing roller when the fixing temperature was set at 180° C.

The amount ratio of the carnauba wax contained in the toner TB-4 was greater than 42.0% by mass. When the toner TB-4 was preserved at a high temperature for a specific period of time, the agglomeration rate became higher than those of the toners TA-1 to TA-9 preserved at the high temperature for the specific period of time. In image formation with the toner TB-4, the evaluation paper was wrapped around the fixing roller even when the fixing temperature was set at 170° C.

The amount ratio of the carnauba wax contained in the toner TB-5 was smaller than 21.0% by mass. The maximum fixing temperature of the toner TB-5 was lower than the desired value. When the toner TB-5 was preserved at a high temperature for a specific period of time, the agglomeration rate became higher than those of the toners TA-1 to TA-9 preserved at the high temperature for the specific period of time. In image formation with the toner TB-5, even the initial image density became lower than the desired value.

The amount ratio of the carnauba wax contained in the toner TB-6 was smaller than 21.0% by mass. The maximum fixing temperature of the toner TB-6 was lower than the desired value. In image formation using the toner TB-6, the evaluation paper was wrapped around the fixing roller when the fixing temperature was set at 180° C. In image formation with the toner TB-6, even the initial image density became lower than the desired value.

The amount of the crystalline polyester resin A contained in the toner TB-7 was greater than 19 parts by mass. The maximum fixing temperature of the toner TB-7 was lower than the desired value. When the toner TB-7 was preserved at a high temperature for a specific period of time, the agglomeration rate became higher than those of the toners TA-1 to TA-9 preserved at the high temperature for the specific period of time. In image formation with the toner TB-7, the evaluation paper was wrapped around the fixing roller even when the fixing temperature was set at 170° C. In image formation with the toner TB-7, the image density became lower than the desired value after the continuous printing.

The amount of the crystalline polyester resin A contained in the toner TB-8 was smaller than 5 parts by mass. The minimum fixing temperature of the toner TB-8 was higher than the desired value. When the toner TB-8 was preserved at a high temperature for a specific period of time, the agglomeration rate became higher than those of the toners TA-1 to TA-9 preserved at the high temperature for the specific period of time. In image formation with the toner TB-8, the evaluation paper was wrapped around the fixing roller even when the fixing temperature was set at 170° C.

The toner TB-9 contained no carnauba wax. In image formation using the toner TB-9, even the initial image density became lower than the desired value.

The above results show that the positively chargeable toner according to the present disclosure is excellent in low-temperature fixability, heat-resistant preservation stability, and charge stability.

What is claimed is:

1. A positively chargeable toner comprising a plurality of toner particles, wherein the toner particles each contain a crystalline polyester resin, a non-crystalline polyester resin, a carnauba wax, and a quaternary ammonium salt, the crystalline polyester resin has an SP value of at least 10.0 $(cal/cm^3)^{1/2}$ and no greater than 10.1 $(cal/cm^3)^{1/2}$, an amount of the crystalline polyester resin is at least 5 parts by mass and no greater than 19 parts by mass relative to 100 parts by mass of the toner particles, and an amount of the carnauba wax is at least 21.0% by mass and no greater than 42.0% by mass relative to a total mass of the crystalline polyester resin, the quaternary ammonium salt, and the carnauba wax.

2. The positively chargeable toner according to claim 1, wherein the crystalline polyester resin is a polymer of a monomer mixture including an aliphatic diol having a carbon number of at least 2 and no greater than 8 and an aliphatic dicarboxylic acid having a carbon number of at least 4 and no greater than 8, and the monomer mixture does not include a carboxylic acid having a carbon number of at least 10.

3. The positively chargeable toner according to claim 1, wherein the non-crystalline polyester resin has an SP value of at least 10.5 $(cal/cm^3)^{1/3}$ and no greater than 10.8 $(cal/cm^3)^{1/2}$.

4. The positively chargeable toner according to claim 3, wherein the non-crystalline polyester resin is a polymer of monomers including a tri- or higher-basic carboxylic acid.

* * * * *